US010161099B2

(12) United States Patent
May et al.

(10) Patent No.: US 10,161,099 B2
(45) Date of Patent: Dec. 25, 2018

(54) GEOSYNTHETIC CONNECTION SYSTEMS AND METHODS FOR MECHANICALLY STABLIZED EARTH WALLS

(71) Applicants: Robert E. May, Friendswood, TX (US); Guy C. Nelson, Byron Center, MI (US)

(72) Inventors: Robert E. May, Friendswood, TX (US); Guy C. Nelson, Byron Center, MI (US)

(73) Assignee: Tricon Precast, Ltd., Houston, TX (US)

( * ) Notice: Subject to any disclaimer, the term of this patent is extended or adjusted under 35 U.S.C. 154(b) by 0 days.

(21) Appl. No.: 14/578,702

(22) Filed: Dec. 22, 2014

(65) Prior Publication Data

US 2016/0177533 A1 Jun. 23, 2016

(51) Int. Cl.
*E02D 29/02* (2006.01)
*E02D 5/80* (2006.01)

(52) U.S. Cl.
CPC ..... *E02D 29/0241* (2013.01); *E02D 5/80* (2013.01); *E02D 29/0233* (2013.01); *E02D 2300/00* (2013.01)

(58) Field of Classification Search
CPC ..... E02D 29/0241; E02D 29/0266; E02D 29/0225
USPC ..... 405/262, 284, 286, 287, 30
See application file for complete search history.

(56) References Cited

U.S. PATENT DOCUMENTS

| | | | | |
|---|---|---|---|---|
| 4,117,686 | A | 10/1978 | Hilfiker | |
| 4,329,089 | A | 5/1982 | Hilfiker | |
| 4,391,557 | A | 7/1983 | Hilfiker | |
| 4,505,621 | A | 3/1985 | Hilfiker | |
| 4,856,939 | A | 8/1989 | Hilfiker | |
| 5,507,599 | A * | 4/1996 | Anderson | E02D 29/02 405/262 |
| 5,722,799 | A | 3/1998 | Hilfiker | |
| 5,965,467 | A * | 10/1999 | Stevenson | D03D 9/00 405/129.75 |
| 6,447,212 | B2 * | 9/2002 | Orsat | E02D 29/0241 405/262 |
| 6,860,681 | B2 * | 3/2005 | Ruel | E02D 29/0225 405/262 |

(Continued)

*Primary Examiner* — James G Sayre
(74) *Attorney, Agent, or Firm* — C. Dale Quisenberry

(57) ABSTRACT

A connection system for stabilizing an earth wall is disclosed. The system may include a geosynthetic loop assembly partially embedded within a concrete panel. The geosynthetic loop assembly may include a plurality of spaced apart geosynthetic loops that may be connected by at least one transverse geosynthetic strip. The geosynthetic loops are partially embedded within the concrete panel and partially extending from a front face of the concrete panel in generally aligned relationship. The system may also include a geosynthetic reinforcement web including a plurality of longitudinal geosynthetic strips and a plurality of transverse geosynthetic strips. The web may be folded to form a fold and the longitudinal strips adjacent the fold may be positioned adjacent the geosynthetic loops extending from the front face of the concrete panel in aligned relationship to form a passageway. The system may include a locking member disposed in the passageway to engage the geosynthetic loop assembly to the geosynthetic reinforcement web.

18 Claims, 4 Drawing Sheets

(56) References Cited

U.S. PATENT DOCUMENTS

2014/0270991 A1* 9/2014 Ogorchock ..... E02D 29/0266
405/286

* cited by examiner

GEOSYNTHETIC CONNECTION SYSTEMS AND METHODS FOR MECHANICALLY STABLIZED EARTH WALLS

BACKGROUND OF THE INVENTION

1. Field of the Invention

The present inventions generally pertain to retaining walls for use in the road construction industry, and more particularly to improved connection systems and related methods for use with mechanically stabilized earth walls.

2. Description of the Related Art

It is known within a variety of fields to construct retaining walls for various purposes. Within the road construction industry, for example, it is known to erect temporary and permanent retaining walls for embankments, roadway supports, bridge abutments and the like. It is also known that these retaining walls can be constructed using a variety of techniques and materials, including, for example, concrete and/or welded wire components. An example of a precast modular wall panel is disclosed in U.S. Pat. No. 5,259,704 to Ogorchock. Examples of retaining walls constructed using welded wire components may be found in a number of U.S. patents, including, for example, U.S. Pat. No. 4,117,686 to Hilfiker, U.S. Pat. No. 4,329,089 to Hilfiker et al., U.S. Pat. No. 4,391,557 to Hilfiker et al., U.S. Pat. No. 4,505,621 to Hilfiker et al., U.S. Pat. No. 4,856,939 to Hilfiker, and U.S. Pat. No. 5,722,799 to Hilfiker.

In the above-listed patents, the precast concrete panels, which are used to form earth walls, are mechanically-stabilized by the use of welded wire grids or steel mesh soil mats that are connected to wire or steel anchor members that are precast and partially embedded into the concrete panels. Instead of these metallic grids and wire/steel anchor members, however, another approach to stabilizing precast concrete panels has developed in which geosynthetic grid materials are used instead of steel and wire components. One advantage of this approach is that geosynthetic grid materials are less expensive than steel. As will become apparent from the following descriptions and discussion, the present inventions employ the use of geosynthetic materials in unique and novel ways to achieve improved connection systems and related methods in comparison to those disclosed in the above-listed disclosures.

SUMMARY OF THE INVENTION

Geosynthetic connection systems for use in the construction of earth walls are disclosed. In one aspect, an embodiment of a connection system for stabilizing an earth wall may comprise: a geosynthetic loop assembly partially embedded within a concrete panel, the geosynthetic loop assembly including a plurality of spaced apart geosynthetic loops, the spaced apart geosynthetic loops being connected by at least one transverse geosynthetic strip, the spaced apart geosynthetic loops being partially embedded within the concrete panel and partially extending from a front face of the concrete panel in generally aligned relationship. Another feature of a specific embodiment of a connection system may include a geosynthetic reinforcement web including a plurality of longitudinal geosynthetic strips and a plurality of transverse geosynthetic strips, the geosynthetic reinforcement web being folded to form a fold and the longitudinal strips adjacent the fold being positioned adjacent the geosynthetic loops extending from the front face of the concrete panel in aligned relationship to form a passageway. Another feature of a specific embodiment of a connection system may include a locking member disposed in the passageway to engage the geosynthetic loop assembly to the geosynthetic reinforcement web. Another feature of a specific embodiment of a connection system may include an internal connection member disposed within the concrete panel, and the geosynthetic loops disposed within the concrete panel being wrapped around the internal connection member. Another feature of a specific embodiment of a connection system may be that the internal connection member is a metal bar disposed horizontally within the concrete panel. Another feature of a specific embodiment of a connection system may further include a plurality of generally vertical metal reinforcement bars disposed within the concrete panel between the internal connection member and the front face of the concrete panel. Another feature of a specific embodiment of a connection system may be that the locking member is comprised of one of steel, plastic and fiberglass. Another feature of a specific embodiment of a connection system may be that the locking member is a rod having a diameter of approximately one inch. Another feature of a specific embodiment of a connection system may be that the geosynthetic loops are connected by staples. Another feature of a specific embodiment of a connection system may be that at least one of the staples is within the concrete panel. Another feature of a specific embodiment of a connection system may be that at least one of the staples is outside of the concrete panel.

In another aspect, a specific embodiment of an earth wall may include a plurality of concrete panels, each concrete panel including a plurality of geosynthetic loop assemblies. Another feature of a specific embodiment of an earth wall may be that each geosynthetic loop assembly may include a plurality of geosynthetic loops arranged in spaced apart and aligned relationship, the geosynthetic loops being partially embedded within one of the plurality of concrete panels and partially extending from the one of the plurality of concrete panels. Another feature of this aspect of a connection system may be that the system includes a plurality of geosynthetic reinforcement webs, each geosynthetic reinforcement web including a plurality of longitudinal geosynthetic strips and a plurality of transverse geosynthetic strips, each geosynthetic reinforcement web being folded to form a fold positioned in interlocking relationship with the geosynthetic loops on a corresponding one of the geosynthetic loop assemblies, the fold and the aligned loops forming a passageway. Another feature of this aspect of a connection system may be that the system includes a plurality of locking members, each locking member disposed in one of the passageways formed by corresponding geosynthetic loop assemblies and geosynthetic reinforcement webs. Another feature of a specific embodiment of a connection system may be that each concrete panel may include an internal connection member disposed therein and corresponding to one of the plurality of geosynthetic loop assemblies, the geosynthetic loops corresponding to said one of the plurality of geosynthetic loop assemblies being wrapped around the corresponding internal connection member. Another feature of a specific embodiment of a connection system may be that each internal connection member may be a metal bar disposed horizontally within one of the concrete panels. Another feature of a specific embodiment of a connection system may be that each concrete panel may further include a plurality of generally vertical metal reinforcement bars disposed within each concrete panel between the corresponding internal connection member and a front face of the concrete panel. Another feature of a specific embodiment of a connection system may be that each locking member may be comprised of one of steel, plastic and fiberglass. Another feature of a specific embodiment of a connection system may be that each of the locking members may be a rod having a diameter of approximately one inch. Another feature of a specific embodiment of a connection system may be that the geosynthetic loops may be connected by staples. Another feature of a specific embodiment of a connection system may be that at least one of the staples may be within one of the concrete panels. Another feature of a specific embodiment of a connection system may be that at least one of the staples may be outside of one of the concrete panels.

Other features, aspects and advantages of the present inventions will become apparent from the following discussion and detailed description.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
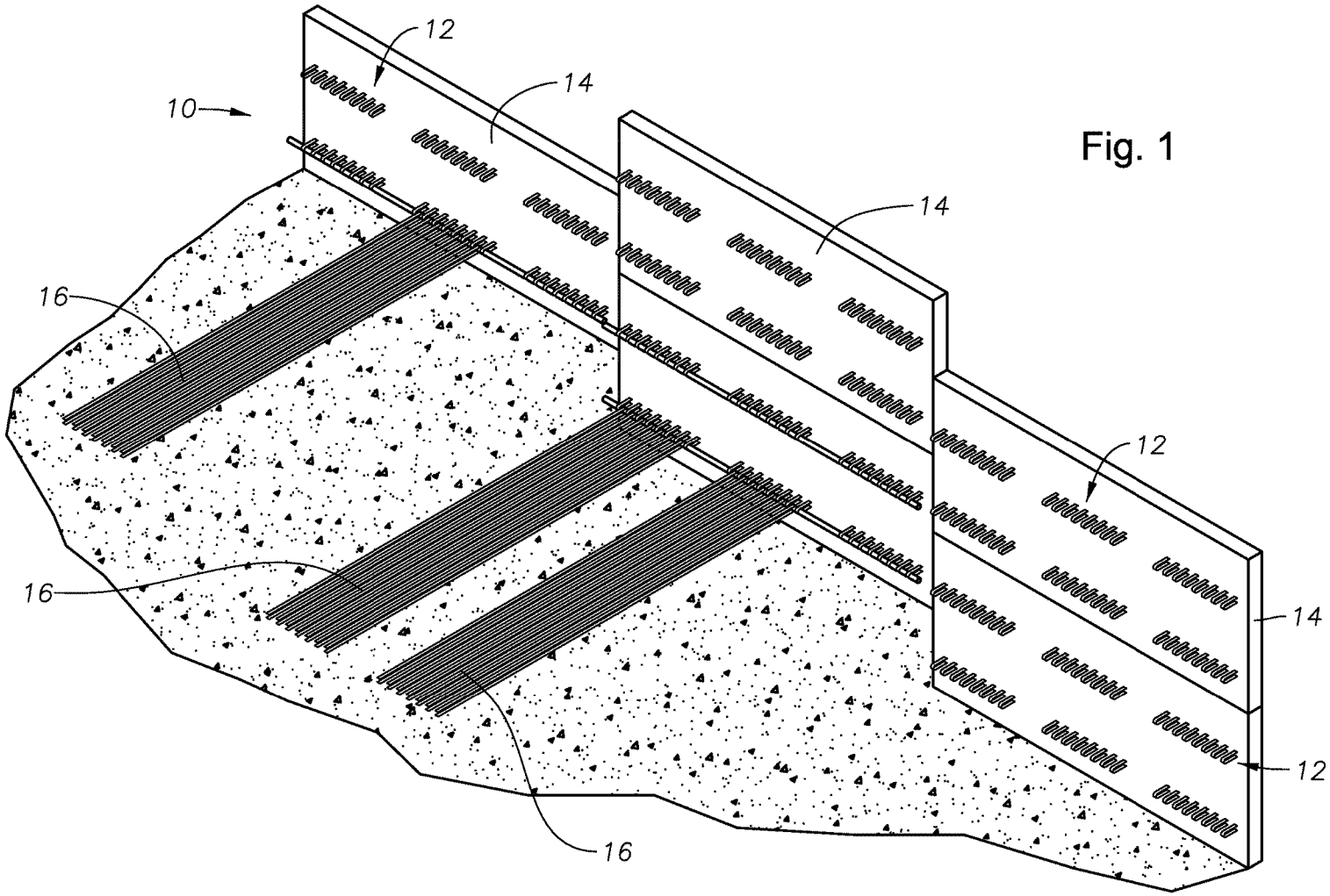
FIG. 1 is a perspective view of a mechanically stabilized earth wall employing a specific embodiment of a connection system as disclosed and discussed hereinbelow.

Referring to the drawings in detail, wherein like numerals denote identical elements throughout the several views, and referring initially to FIG. 1, there is shown a specific embodiment of a connection system 10 for a mechanically stabilized earth wall. In a specific embodiment, the connection system 10 may include one or more geosynthetic loop assemblies 12 partially embedded in at least one precast concrete panel 14 used to form an earth wall. FIG. 1 illustrates an earth wall in the process of being constructed. The completed earth wall will include a plurality of concrete panels 14, as shown, for example, in U.S. Pat. No. 5,259,704 to Ogorchock (see panels 30).

Figure 4:
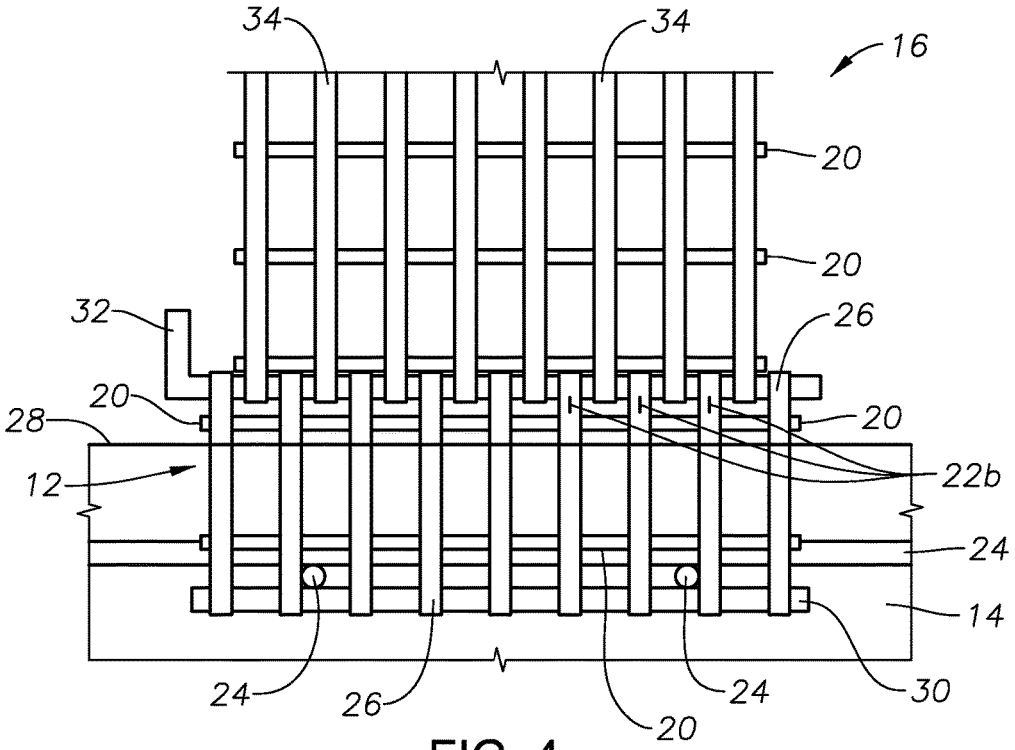
FIG. 4 is a top view showing a geosynthetic loop assembly partially embedded within a concrete panel and engaged with a geosynthetic reinforcement web through the use of a locking member.

Each geosynthetic loop assembly 12 is adapted to secure a geosynthetic reinforcement web 16 to a concrete panel 14. In a specific embodiment, the geosynthetic loop assemblies 12 and geosynthetic reinforcement webs 16 are preferably made from Stratagrid® geogrid material available from Strata Systems, Inc., 380 Dahlonega Road, Cumming, Ga. 30040 (www.geogrid.com), which is available on rolls that are eight (8) feet wide. The geosynthetic loop assemblies 12 and geosynthetic reinforcement webs 16 may be made using the entire width of the roll of geogrid material, or they may be made by cutting the rolls into sections of any desired width. As can be seen in FIG. 4, for example, the geogrid material may include a plurality of longitudinal geosynthetic strips 34 that are connected with a plurality of transverse geosynthetic strips 20, which are disposed in generally perpendicular relationship to the longitudinal geosynthetic strips 34.

Figure 2:
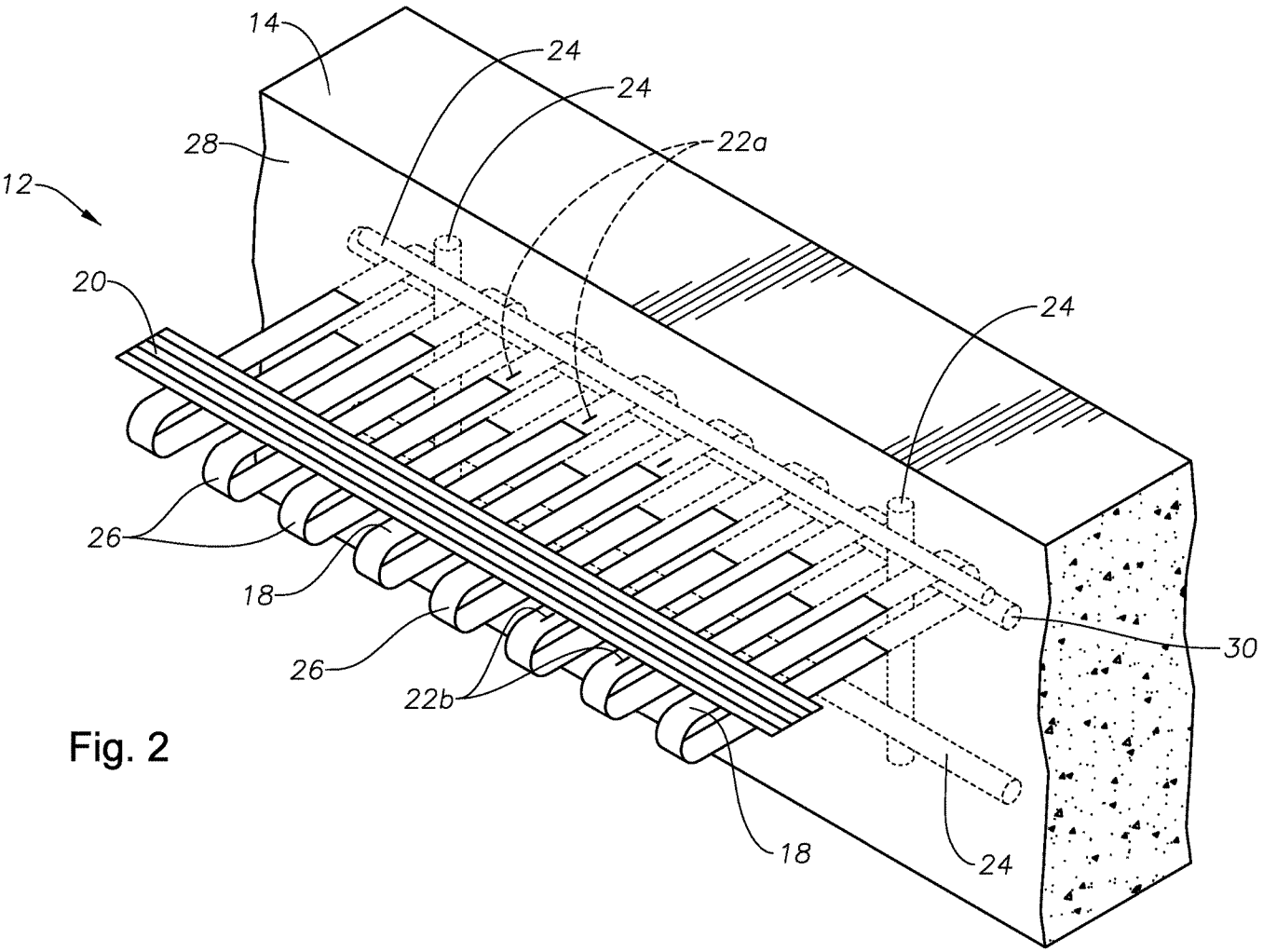
FIG. 2 is an enlarged perspective view of a portion of one of the concrete panels shown in FIG. 1 and illustrates a geosynthetic loop assembly anchored and partially embedded within the concrete panel.

For purposes of illustration only, a specific embodiment of a geosynthetic loop assembly 12 is shown in FIG. 2 embedded within a concrete panel 14. In this specific embodiment, the geosynthetic loop assembly 12 has been cut into a section including eight (8) longitudinal strips 18, and those strips 18 have been folded in overlapping fashion and fastened together (e.g., by staples that may be located either inside or outside of the concrete panel 14). For example, in a specific embodiment, as shown in FIG. 2, the staples 22*a* and overlapped ends of the longitudinal strips 18 are embedded within the concrete panel 14. In another specific embodiment, as shown in FIG. 4, the staples 22*b* and overlapped ends of the longitudinal strips 18 are located outside of the concrete panel 14. In a specific embodiment, the loop assemblies 12 may be made by wrapping the geogrid material two times before stapling the ends together. In a specific embodiment, the length of each loop 26 may be approximately two feet long (i.e., the length of the strips 18 that are formed into loops are approximately four feet long).

Figure 5:
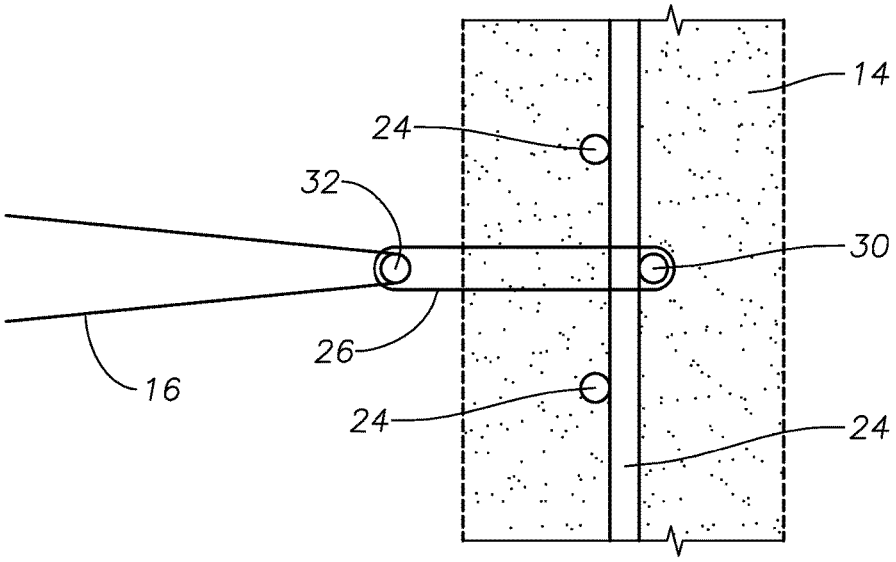
FIG. 5 is a side view of the connection system shown in FIG. 4.

The geosynthetic loop assembly 12 is partially embedded within the concrete panel 14, with the individual loops 26 extending outwardly from a front face 28 of the concrete panel 14. FIG. 2 also illustrates that, in a specific embodiment, the concrete panel 14 may include reinforcing metal bars 24 (sometimes referred to as "rebar") embedded within the concrete panel 14 to reinforce the concrete in a known grid-like manner. This is further shown in the side view shown in FIG. 5. With reference to FIG. 2, in a specific embodiment, the ends of the loops 26 that are within the concrete panel 14 may optionally be wrapped around an internal connection member 30 (e.g., a section of rebar) that preferably rests horizontally against the vertical reinforcing metal bars 24, such that the reinforcing metal bars 24 are positioned between the internal connection member 30 and the front face 28 of the concrete panel 14. In another specific embodiment, the loops 26 may simply be cast into the concrete panel 14 without wrapping around any internal connection member 30.

Figure 3:
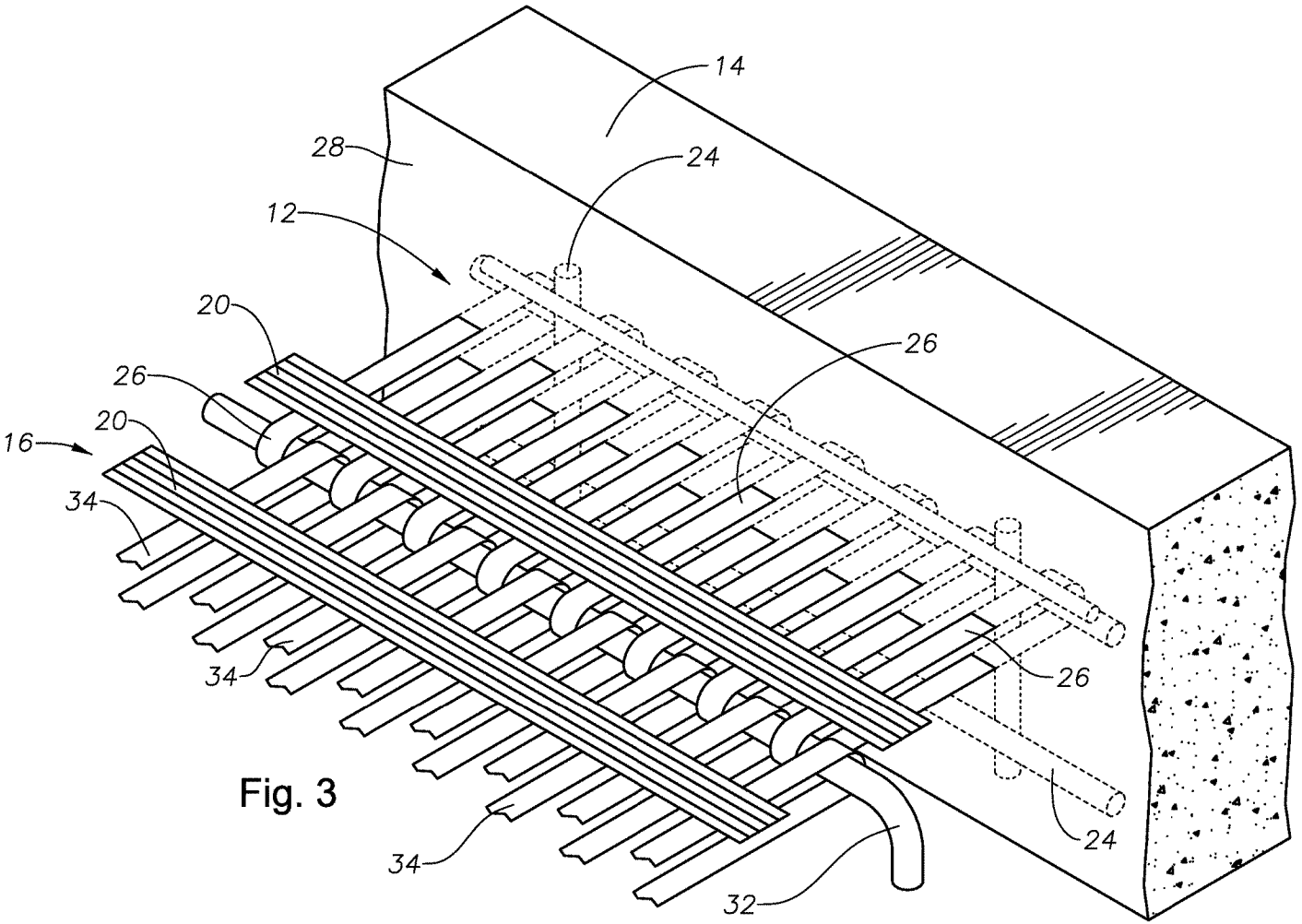
FIG. 3 is a perspective view similar to FIG. 2, but also showing a geosynthetic reinforcement web engaged with the geosynthetic loop assembly through the use of a locking member.

Referring now to FIG. 3, a geosynthetic reinforcement web 16 is shown engaged with the geosynthetic loop assembly 12 through the use of a locking member 32. In various specific embodiments, the locking member 32 may be made from a variety of materials, including but not limited materials such as steel, plastic and fiberglass. In a specific embodiment, the locking member 32 may be a rod having a diameter of approximately one inch. In a specific embodiment, the locking member 32 may include a curved handle on one end, as shown in FIG. 3.

In the specific embodiment shown in FIG. 3, the geosynthetic reinforcement web 16 includes seven (7) longitudinal strips 34 and one or more transverse geosynthetic strips 20. After the geosynthetic reinforcement web 16 is folded, each of the longitudinal strips 34 of the geosynthetic reinforcement web 16 at the location of the folded area is positioned adjacent a corresponding loop 26 on the geosynthetic loop assembly 12 in an interlocking manner (e.g., like fingers fitting together) so as to form a passageway to receive the locking member 32. Once the locking member 32 is fed through the passageway, the geosynthetic reinforcement web 16 may then be pulled tightly against the locking member 32, and positioned for backfill as shown for example in FIG. 1 in a known manner. The length of the geosynthetic reinforcement web 16 is determined based on how far the web 16 needs to extend away from the concrete wall 14 for the design parameters of a given project. For example, in a specific embodiment, each geosynthetic reinforcement web 16 may extend away from the concrete wall 14 by a distance in the range from 10 to 20 feet.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will, however, be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims.

The invention claimed is:

1. A connection system for stabilizing an earth wall comprising:

a geosynthetic loop assembly partially embedded within a concrete panel, the geosynthetic loop assembly including a plurality of spaced apart geosynthetic loops, the spaced apart geosynthetic loops being connected by at least one transverse geosynthetic strip, the spaced apart geosynthetic loops being partially embedded within the concrete panel and partially extending from a front face of the concrete panel in generally aligned relationship;

a geosynthetic reinforcement web including a plurality of longitudinal geosynthetic strips and a plurality of transverse geosynthetic strips, the geosynthetic reinforcement web being folded to form a fold and the longitudinal strips adjacent the fold being positioned adjacent the geosynthetic loops extending from the front face of the concrete panel in aligned relationship to form a passageway;

a locking member disposed in the passageway to engage the geosynthetic loop assembly to the geosynthetic reinforcement web.

2. The connection system of claim 1, further including an internal connection member disposed within the concrete panel, and the geosynthetic loops disposed within the concrete panel being wrapped around the internal connection member.

3. The connection system of claim 2, wherein the internal connection member is a metal bar disposed horizontally within the concrete panel.

4. The connection system of claim 2, further including a plurality of generally vertical metal reinforcement bars disposed within the concrete panel between the internal connection member and the front face of the concrete panel.

5. The connection system of claim 1, wherein the locking member is comprised of one of steel, plastic and fiberglass.

6. The connection system of claim 1, wherein the locking member is a rod having a diameter of approximately one inch.

7. The connection system of claim 1, wherein the geosynthetic loops are connected by staples.

8. The connection system of claim 7, wherein at least one of the staples is within the concrete panel.

9. The connection system of claim 8, wherein at least one of the staples is outside of the concrete panel.

10. An earth wall comprising:

a plurality of concrete panels, each concrete panel including a plurality of geosynthetic loop assemblies;

each geosynthetic loop assembly including a plurality of geosynthetic loops arranged in spaced apart and aligned relationship, the geosynthetic loops being partially embedded within one of the plurality of concrete panels and partially extending from the one of the plurality of concrete panels;

a plurality of geosynthetic reinforcement webs, each geosynthetic reinforcement web including a plurality of longitudinal geosynthetic strips and a plurality of transverse geosynthetic strips, each geosynthetic reinforcement web being folded to form a fold positioned in interlocking relationship with the geosynthetic loops on a corresponding one of the geosynthetic loop assemblies, the fold and the aligned loops forming a passageway; and a plurality of locking members, each locking member disposed in one of the passageways formed by corresponding geosynthetic loop assemblies and geosynthetic reinforcement webs.

11. The earth wall of claim 10, wherein each concrete panel includes an internal connection member disposed therein and corresponding to one of the plurality of geosynthetic loop assemblies, the geosynthetic loops corresponding to said one of the plurality of geosynthetic loop assemblies being wrapped around the corresponding internal connection member.

12. The connection system of claim 11, wherein each internal connection member is a metal bar disposed horizontally within one of the concrete panels.

13. The connection system of claim 12, wherein each concrete panel further includes a plurality of generally vertical metal reinforcement bars disposed within each concrete panel between the corresponding internal connection member and a front face of the concrete panel.

14. The connection system of claim 10, wherein each locking member is comprised of one of steel, plastic and fiberglass.

15. The connection system of claim 10, wherein each of the locking members is a rod having a diameter of approximately one inch.

16. The connection system of claim 10, wherein the geosynthetic loops are connected by staples.

17. The connection system of claim 16, wherein at least one of the staples is within one of the concrete panels.

18. The connection system of claim 16, wherein at least one of the staples is outside of one of the concrete panels.

* * * * *